United States Patent [19]

Seifert

[11] 4,099,458

[45] Jul. 11, 1978

[54] CONE PRESS

[75] Inventor: Peter Seifert, Middletown, Ohio

[73] Assignee: The Black Clawson Company, Middletown, Ohio

[21] Appl. No.: 673,445

[22] Filed: Apr. 5, 1976

Related U.S. Application Data

[63] Continuation-in-part of Ser. No. 563,124, Mar. 28, 1975, Pat. No. 3,948,165.

[51] Int. Cl.[2] ..... B30B 9/06; B30B 3/04

[52] U.S. Cl. ..... 100/116; 100/158 C; 308/107; 308/122

[58] Field of Search ..... 100/116, 158 R, 158 C, 100/170; 308/9, 107, 109, 122, 123, 168, 170

[56] References Cited

U.S. PATENT DOCUMENTS

| | | | |
|---|---|---|---|
| 2,695,199 | 11/1954 | Blizard | 308/122 X |
| 3,053,171 | 9/1962 | Asplund | 100/158 C |
| 3,146,037 | 8/1964 | Hooker | 308/168 X |
| 3,165,365 | 1/1965 | Wiedemann et al. | 308/170 |
| 3,447,450 | 6/1969 | Wilhelm | 100/158 C X |
| 3,711,167 | 1/1973 | Enms | 308/9 |
| 3,753,604 | 8/1973 | Arsenius | 308/160 |
| 3,841,719 | 10/1974 | Smith | 308/9 |

*Primary Examiner*—Peter Feldman
*Attorney, Agent, or Firm*—Biebel, French & Nauman

[57] ABSTRACT

A press, including a frame, a pair of rigid side structures, means for pivotally connecting the side structures to said frame, a pair of rotor assemblies having confronting faces arranged at an angle to each other and defining a pressing zone, each of the rotor assemblies being mounted for rotation in a respective side member, means interconnecting the side structures to one another and serving to apply yieldable force to urge the side structures toward one another, the improvements basically comprising means for adjusting the pivotal connecting means to vary the pressing action of the rotor assemblies, and a hydrostatic bearing means, which may be used in association with an annular thrust bearing, for minimizing the friction between the rotor assemblies and the side structures.

8 Claims, 9 Drawing Figures

FIG-4
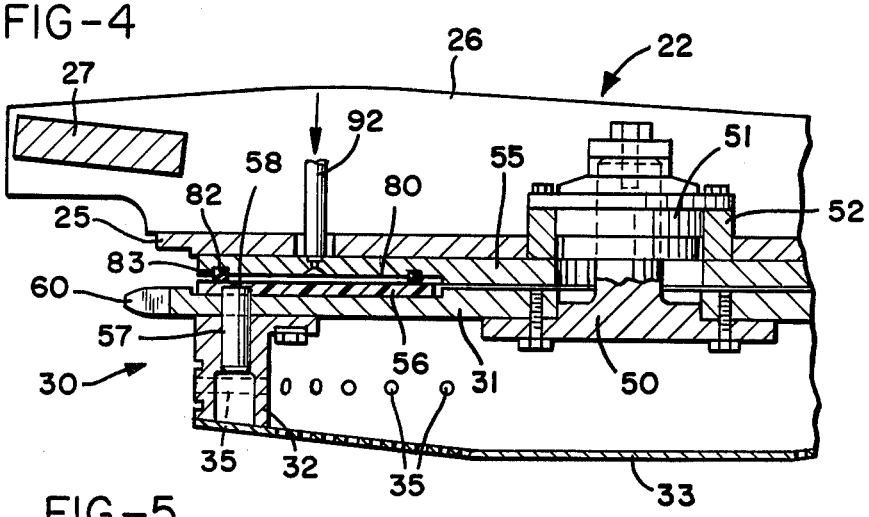
FIG-6
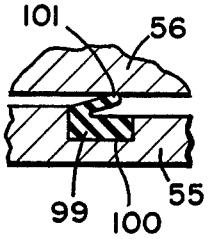
FIG-5
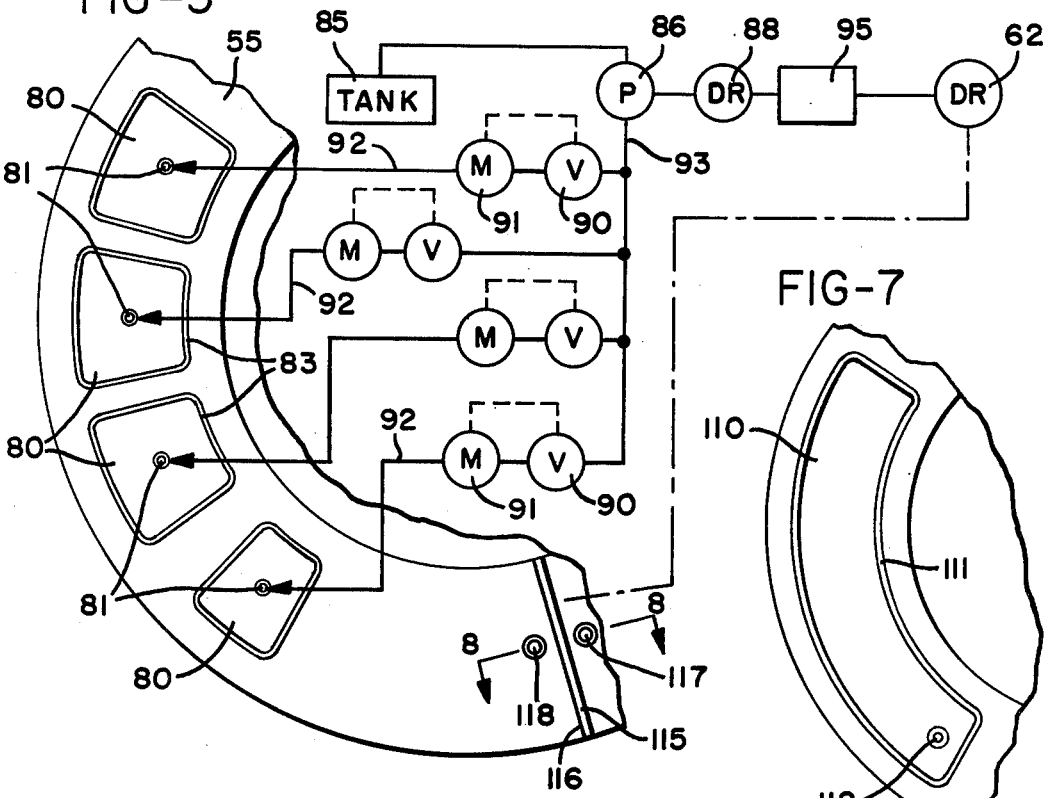
FIG-7
FIG-8
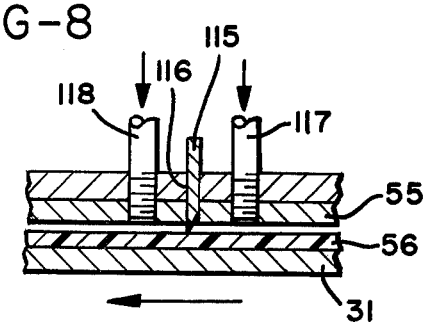
FIG-9
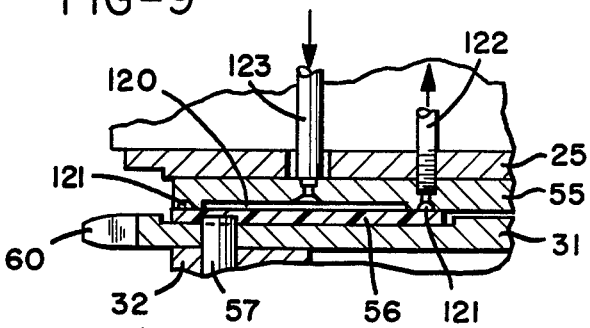

CONE PRESS

CROSS REFERENCE TO COPENDING APPLICATION

This application is a continuation-in-part of my application Ser. No. 563,124, filed Mar. 28, 1975, now U.S. Pat No. 3,948,165.

BACKGROUND OF THE INVENTION

This invention relates generally to presses of the continuous type such as are employed for extracting water or other liquids for various fluids or semi-fluid feed materials, and specifically to cone presses wherein the screening surfaces are shaped to conform to truncated cones.

Although the invention will be described in terms of extracting water from paper pulps or slurries, the invention is also applicable in extracting liquid from said other pulps, slurries, and semi-solid materials. Examples of other materials include sewage sludges, vegetable and fruit pulps, tomato and grape pomace, citrus peel, fish or fish process slurries, cannery wastes, and brewers and distillers grains.

In extracting liquids from feed materials in a press, filter screens are caused to compress the solids of the feed to effect a reduction in volume, which in turn causes liquid to be expelled through the screen. In a cone press, a pair of rotating wheels or disks are faced with screens shaped to conform to truncated cones, and the volumetric compression is done by the co-acting cones.

The construction of the cone press is such that the axes of rotation of the cone wheels are normally intersecting but out of alignment whereby the screens are brought into close opposition in a pinch or nip region, but are separated apart a substantial distance in a wide region diametrically opposite the pinch region. The two cone wheels are driven continuously in the same direction, usually by gear pinions on a common drive shaft which mesh with gear teeth provided on the peripheries of the wheels or by a chain drive which also operates on teeth on the peripheries of the wheels. A casing extends between the peripheries of the wheels and is provided with an inlet for the feed slurry and also with an outlet for the removal of the squeezed or dewatered solids. A partition member or plow extends between the cone wheels from one portion of the casing to the center area between the cones and serves to direct the flow of material between the screen surfaces.

In operation, the feed is continuously introduced in the wide region of the inlet and continuously carried between the screens through the pinch or nip region. The squeezed or dewatered solids are withdrawn at the outlet shortly after passing through the nip region, and the liquid is caused to be expressed through the screens, and is collected by an appropriate means. In one form of early prior such continuous press, the location of the wheels remained fixed during operation, so that the spacing of the screens in the pinch region remained constant.

Continuous presses of the prior type described above are subject to a number of disadvantages. The performance and capacity of such a press is dependent upon the rate of feed and also upon variations in the solids content of the feed material. This is because the pressure applied to the solids in the pinch region varies with the amount of solids present, and this in turn is dependent upon the rate of feed and the solids content of the feed. At high feed rates, overloading of the press can occur. In many instances, this has the effect of limiting the overall capacity of the machine, and it also interferes with attainment of a desired residual liquid content in the expressed solids and in the maintenance of a desired residual liquid content over long operating periods.

Another disadvantage of the early prior cone presses is that the means generally employed to take the thrust against the core wheels have been thrust rollers tracking on the outer faces of the wheels, or bearings into which the cone wheel support shaft is journalled, and these are generally unsatisfactory because they are complicated and subject to excessive wear. Further, such prior continuous presses have not been amenable to quick adjustments to accommodate different types of feed materials, and their design has not facilitated ready access to the screens for replacement or repair, or for cleaning.

More recent prior cone presses wherein the cone wheel supports are pivotally connected with respect to a fixed point will allow adjustment to maintain a constant pressing force. They do so by adjusting mainly the nip width, which is the distance between the conical screen surfaces at the point of their closest proximity. As a result, the compression ratio, which is the ratio between the large feed flow area and the small nip flow area, also changes. However, the distribution of nip widths and of the compression ratios along the radius of the cone wheels changes in a preset, i.e., non-adjustable, manner. Typical such presses are shown in U.S. Pat. Nos. 3,447,450 (Wilhelm) and, 3,105,434 (Messing).

A cone press according to U.S. Pat. No. 3,447,450 (Wilhelm), which features support structures for the wheels with pivotal supports on one end of the support structures and a yieldable connection at the other end of the support structures, exhibits a complicated relationship between compression ratio and nip width. As an example, when the side structures are moved apart, the nip width changes along the radius of the wheel, namely, it becomes greater for greater radii. The compression ratio will also change, namely it generally decreases, but the rate of decrease is greater at greater radii. As a result, the residual moisture content of material at the greater radii would be greater than the moisture content of the material in the center areas. Thus, when more material is fed in the press, the discharge in the outer regions — of greater radii — will become relatively wet.

In order to overcome the problems caused by using thrust rollers, some presses have employed a friction pad, such as a high density polyethylene or nylon annulus. Such a thrust bearing structure is relatively simple in construction and allows for a uniform distribution of the thrust generated in the pressing operation. But such structures require a high power input in order to overcome the friction between the pads and the rotating disk.

Thus a need exists for an improved press which has a more uniform dewatering capability, and improved thrust bearing means, for absorbing the loads on the cone wheels, especially in the zones of maximum pressure.

SUMMARY OF THE INVENTION

The invention is broadly an improved press, and specifically an improved cone press having a more uniform dewatering capability, an improved thrust bearing means, and an improved sealing means which prevents leakage from the inlet section of the pressing zone to the outlet section.

The basic press structure comprises a frame, a pair of rigid side structures pivotally supported on the frame, and a pair of rotor assemblies having confronting faces covered with cone shaped screens arranged at an angle to each other which define a pressing zone. Each of the rotor assemblies is mounted for rotation in a respective side member, and means are provided to interconnect the side structures to one another and to apply a yieldable force to urge the side structures toward one another. The side structures are hingedly connected to the frame by hinge pins passed through brackets extending from the side structures.

The present invention provides a press in which both the radial distribution of the volumetric compression ratio and the radial distribution of the width of the nip are adjustable to provide a more uniform dewatering capability by providing a means for adjusting the pivotal connection. In one embodiment, a plurality of hinge openings are provided in the frame and the hinge brackets. By matching openings in the hinge bracket with openings in the frame, a plurality of hinge points are available for adjusting the point of pivot. To readjust, the hinge pin is pulled out, another of the openings of the hinge bracket is superposed over another of the openings in the frame, and the hinge pin is reinserted. Alternative pivotal adjustment means include screw adjustment means, hydraulic adjustment means, and eccentric adjustment means.

In order to appreciate fully the need for the extra adjustment in the cone press, the various factors which affect pressing should once more be considered. The three factors which — in a given process operation — will provide the thickening action are:

1. Time.
2. Compression Ratio.
3. Nip Width.

In a press consisting of two parallel cylinders, all three factors are constant along the entire length of the nip. The pressing result is therefore uniform along the entire length of the nip. In cone presses, however, only two of the three factors can be held constant because of geometrical necessity. The pressing time will be the same, no matter at what point of the radius the furnish enters the press. If the nip width is held constant along the radius, the comparison ratio varies. It would be higher in the outer regions (largest radius) and lower in the inner regions (smallest radius) of the press; thus yielding a drier material on the outside and a wetter material on the inside regions.

If one attempts to maintain constant compression ratio, the nip width will vary; namely, it will be greater in the outer regions and smaller in the inner regions of the press, yielding wetter discharge material on the outside and drier discharge material on the inside regions. This difficulty was recognized by the above Wilhelm patent by a press utilizing a compromising configuration, where both nip width and compression ratio are varied in a fixed relationship. It is apparent that the compromise, while it may be beneficial for one material, may not be an optimal solution for another with different dewatering characteristics. The possibility of adjusting the pivot points of the press in the field is therefore a significant improvement over the existing presses.

The improved thrust bearing means are hydrostatic bearings comprising an annular surface on each of the side structures which faces the back of the associated cone wheel and has formed therein one or more relatively shallow flat pockets arranged opposite the nip area or pinch zone of the press. Lubricant or other fluid is fed into the pocket, via an inlet in the bottom of the pocket, so that the pocket fills with fluid. The rotor assembly can carry an annular thrust bearing pad of high density polyethylene or nylon for rotation against the fluid-filled pocket. When this fluid in the pockets is pressurized to compensate hydraulically for the major portion of the thrust load, there will be lower friction forces between each cone and its supporting structure, thus reducing the power required to drive the press. Additionally, the bearing is relatively simple, which minimizes the possibilities for mechanical breakdown and wear.

The hydrostatic bearing can be operated by expending a certain amount of lubricant, or by incorporating a U-shaped channel around each pocket, which channel is provided with a return line so that lubricant which over-flows the pocket of the hydrostatic bearing can be collected in the channel and returned for recirculation and reuse. Preferably, each lubricant pocket is surrounded by yieldable sealing means, such as an O-ring, which will have maintained low friction engagement with the associated wheel sufficient to seal against escape of the lubricant.

Other objects and advantages of the invention will be apparent from the following description, the accompanying drawings and the appended claims.

BRIEF DESCRIPTION OF THE DRAWINGS

FIG. 4 is an enlarged fragmentary section through one side structure and rotor assembly, taken as indicated by the line 4—4 of FIG. 1;

FIG. 5 is a fragmentary and somewhat diagrammatic view of the pocket portion of the hydrostatic bearings in FIG. 4 and the associated fluid supply system;

FIG. 6 is a fragmentary view showing modified seal for the hydrostatic bearing arrangement in FIGS. 4–5;

FIG. 7 is a view similar to FIG. 5 illustrating the use of a single hydrostatic pocket in place of the multiple pockets in FIG. 5;

FIG. 8 is a fragmentary section on the line 8—8 on FIG. 5, and;

FIG. 9 is a fragmentary view similar to FIG. 4 showing a different hydrostatic bearing arrangement.

DESCRIPTION OF THE PREFERRED EMBODIMENT

Figure 1:
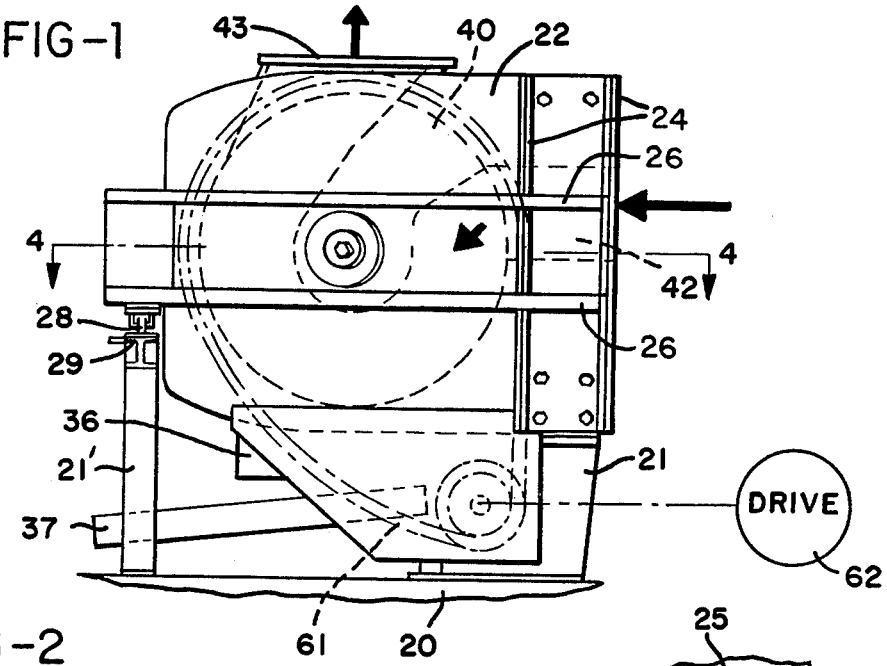
FIG. 1 is an elevational view of the improved cone press of the invention.

The press shown generally in FIG. 1 comprises a base 20 supporting frame members 21 and 21' on which a pair of rigid side structures or doors 22 are pivotally supported. The pivots are indicated generally by the reference numeral 23, and will be discussed in more detail hereinafter. Each door 22 comprises a main plate member 25 to which are welded vertical and horizontal stiffening ribs 24 and 26. The ends of ribs 26 are connected by a plate 27 and are supported for movement on roller bearings 28 on the surface of rail member 29 of frame member 21'.

One of a pair of rotating wheels or rotor assemblies 30 (FIG. 3) is mounted for rotation in each door 22. Each rotor assembly 30 includes a backing plate 31 on which is mounted a cylindrical rim 32 which in turn supports a frustoconical screen 33 having perforations in its conical portion. Holes 35 in the rim 32 provide for drainage of liquid from the interior of the rotor assembly into a collector pan casing 36 from which it flows to a collector pan 37.

The screens 33 form confronting faces arranged at an angle to each other so as to define a pressing zone. A partition member or plow 40 is located between the rotor assemblies 30 and serves to direct the flow of material to be pressed as it enters and leaves the pressing zone. A casing 41, which extends between the peripheries of the rotor assemblies and has an inlet 42 and an outlet 43, encloses the pressing zone and also confines the material between the confronting faces of the screens 33.

Figure 3:
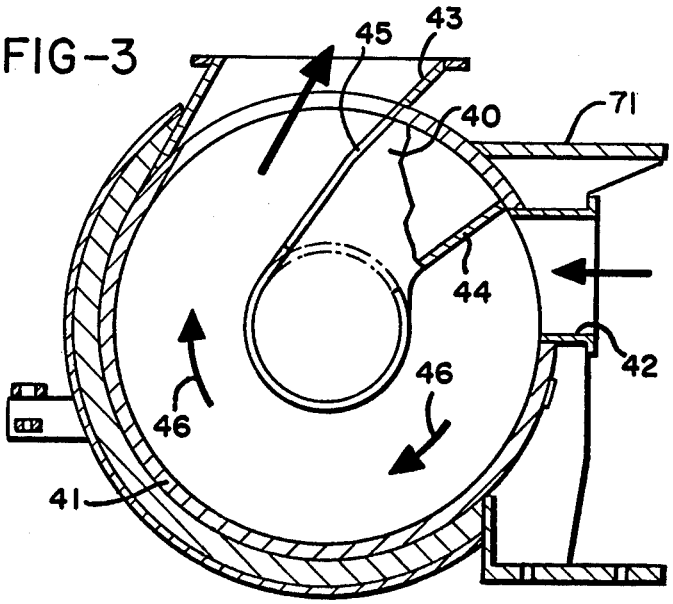
FIG. 3 is a cross-sectional view of the casing and partition member, shown partially in elevation, employed in the cone press of FIGS. 1 and 2.

Plow 40 is a generally U-shaped member comprising a circular portion located in central zone concentrically inward from the screens 33, and generally straight or leg portions 44 and 45 which extend generally radially from the central zone to the casing 41 and between the screens 33. As shown in FIG. 3, the material to be dewatered, such paper pulp, enters the press at inlet 42 and is directed between the screens 33 by the inlet leg 44 of plow 40. The pulp then passes between the confronting faces of the screens 33, as shown by arrows 46, and leaves the press at outlet 43. The slurry or pulp is fed to inlet 42 by any appropriate feed conveyor, and removed from outlet 43 by any appropriate discharge conveyor, both such conveyors being conventional in the art.

Each rotor assembly 30 is mounted for free rotation in the associated door 22 by a stub shaft 50 and bearing 51 in the hub portion 52 of the door 22. This portion of the door is also reinforced and stiffened by an annular plate 55 welded to the main door plate 25 in opposing relation with the backing plate 31. A thrust bearing 56 in the form of an annular pad of self-lubricating material, such as high density polyethylene or nylon, either alone or graphite filled, is mounted near the peripheral edge of the backing plate 31 of rotor assembly 30, and is connected in driven relation with plate 31 by multiple pins 57 press fit in rim 32 and engaged in blind holes 58 in pad 55. The peripheral edge of the backing plate 31 is provided with a plurality of sprocket teeth 60 so that the rotor assembly can be driven by a chain 61 through a suitable drive 62.

Hydraulic means 65 interconnect the free ends of doors 22 and serve to apply yieldable force to urge them toward one another. Hydraulic means 65 comprises a double acting hydraulic cylinder appropriately connected by hinge pins 66 and clevis brackets 67 to the plate members 27 of doors 22. By applying hydraulic fluid to one side of the piston in cylinder 65, the doors 22 and screens 33 are caused to pivot toward one another about pivot points 23. When hydraulic fluid is applied to the other side of the piston in cylinder 65, the doors 22 will move away from each other and increase the distance between screens 33.

Figure 2:
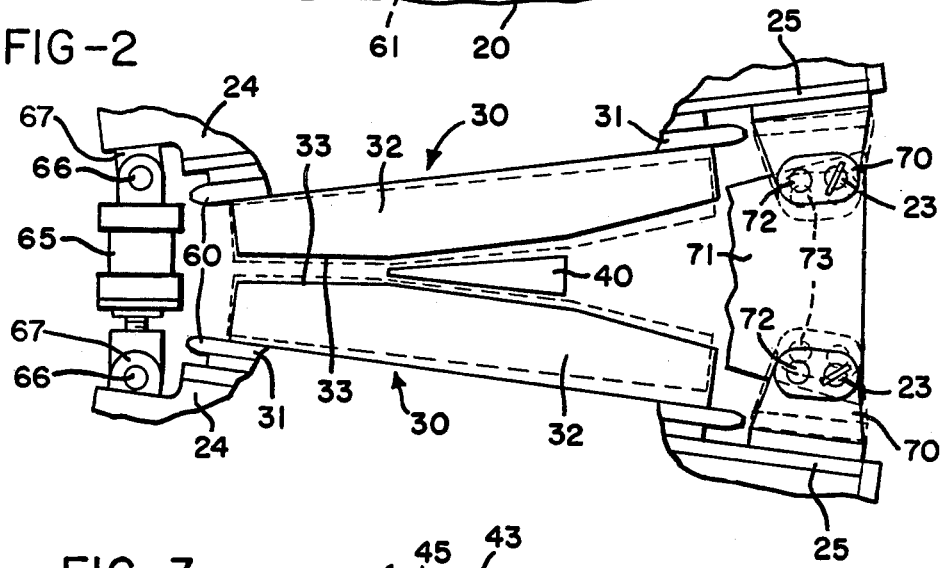
FIG. 2 is a fragmentary top view, partly broken away, of the cone press of FIG. 1.

Adjustment means for adjusting the pivot pin 23 has been provided in the improved press of the invention. Referring to FIG. 2, flanges 70 are attached to doors 22 and extend in a direction normal thereto. A hinge bearing plate 71 extends horizontally and joins the frame members 21. Holes 72 are provided in flanges 70, and corresponding holes 73 are provided in bearing plate 71. Pivot pins 23 are passed through holes 72 and 73 to join flanges 70 to plate 71.

Plural selectively usable holes 72 and 73 provide adjustment for the pivot pins 23. By moving flanges 70 to allign one of holes 72 with one of holes 73, various combinations of hinge points are achieved, as well as adjustment of the distance between the doors 22. With two sets of holes in each of the flanges 70 and each side of the plate 71 as shown in FIG. 2, there are two possible positions; the solid lines represent one of the positions, while the dotted lines represent the alternative position.

While the use of low friction thrust bearing pads 56 is satisfactory for many purposes, including the fact that they are relatively simple in construction and operation, a relatively high power input is required to overcome such friction as there is between the pads and the rotor assemblies. Therefore, the present invention employs hydrostatic bearing means which reduce the power input and, optionally, allow the nip area to be cooled.

As shown in FIGS. 4 and 5, the hydrostatic bearing means comprise relatively shallow, flat pockets 80 formed in the surface of plate 55 facing bearing pad 56. These pockets are located, as shown in FIG. 5, opposite the zone of maximum pressures between the screens 33, because it is only opposite that zone that there are maximum thrust loads to be absorbed by the structure of doors 22, due to the pressure of solid material passing through the nip between the screens 33. An inlet 81 in the bottom of each pocket 80 admits pressurized fluid to the pocket, and a groove 82 surrounds each pocket and holds a yieldable seal 83, shown as an O-ring.

In operation, high viscosity grease or other fluid lubricant enters and fills each pocket 80 from inlet 81 and a supply system comprising a reservoir tank 85 and pump 86 having a drive 88. It is desirable to provide individual control over the pressure in each of the pockets 80, as indicated by the flow control valve 90 and cooperating flow meter or pressure gauge 91 connected in the line 92 between each of the pockets 80 in FIG. 5 and the supply line 93 from the pump 86 and supply tank 85.

This hydrostatic bearing system has a number of advantages unique to the operation of a cone press. In the first place, the thrust loads between the doors 22 and rotor assemblies 30 vary substantially around the circumference of the plates 55, from a maximum value along the nip line where the screen surfaces are closest, to a minimal value along the diametrically opposite line, and the arrangement of the invention locates the bearing means only in those areas where they are needed. In addition, the resilient sealing rings 83 retain the pressure fluid within the pockets 80 over such range of relative angular movements or deflection between the plate 55 and pad 56 as normally occur with variations in the thrusts load between the screens 33.

In operation, there will be enough fluid wiped on the surface of thrust pad 56 as it moves over each pocket 80 to maintain low friction engagement between its surface and the seals 83, as well as between whatever portions of the surfaces of plate 55 and pad 56 as may come into contact with each other. At the same time, each sealing ring can move sufficiently to maintain sealing engagement with the pad 56 over the normal range of its angular movement or deflection with respect to plate 55, and thereby will retain the pressure fluid within the associated pocket 80 against leakage. This cooperative action promotes maintenance of adequate hydrostatic pressure between each pocket and the thrust pad 56 to sustain the thrust loads while effectively floating the rotor assembly through its zone of maximum pressure loading.

It is important to control the fluid supply to the pockets 80 so that leakage is minimized whenever the pulp flow to the press is interrupted and the pressure between the screens 33 is correspondingly reduced. For this purpose, a control 95 is connected between the main drive 62 of the press and the drive 88 for the pump 86, and this control is designed to sense whether the load on drive 62 is high or low and to turn pump drive 88 on or off in accordance with the main drive load. Alternatively, the control 95 may be a modulating control which regulates the pump drive 88 to raise or lower the hydrostatic pressure in response to corresponding variation of the main drive load. Any conventional electrical control device meeting either of these specifications may be used at 95.

FIG. 6 shows an alternative form of yieldable seal 99 which can be used in place of the O-ring 82 in a groove 100 of rectangular section. The seal 99 comprises a base section seated in the groove 100, and a flexible lip 101 which is biased by the fluid in pocket 80 into yieldable sealing engagement with the thrust pad 56.

FIG. 7 shows an alternative to the arrangement of FIG. 5 wherein a single pocket 110 in the surface of each plate 55 covers substantially the same area as the pockets 80, and is surrounded by a yieldable seal 111 such as an O-ring or a ring of the section shown in FIG. 6. This arrangement of a single pocket in each plate 55 can use a simpler fluid supply system, which would not need flow control valves, but it should have a modulating control, as described in connection with control 95 in FIG. 5, which will regulate the pressure fluid supply to minimize leakage in the event of relative angular movement of the thrust pad 56 and of plate 55, the inlet for fluid to pocket 110 being shown at 112.

With all of these hydrostatic bearing arrangements, it is important that the opposed surface of thrust pad 56 be smooth and unbroken, hence the blind holes 58 for its drive pins 57. It is also desirable to provide assurance against contamination of the rotating bearing surface of thrust pad 56 which could cause damage to the seals around the hydrostatic pressure pockets. For this purpose, a scraper 115, such as a thin metal strip, may be mounted in a receiving slot 116 in the surface of plate 55, preferably upstream from the pressure zones as shown in FIG. 5, to clean the surface of thrust pad 56 as it approaches the pressure zone.

With the scraper 115, or as an alternative thereto, provision should be made for flushing the surface of thrust pad 56 with water, as indicated by nozzles 117 and 118 located in plate 55 and provided with a connection to a source of water under pressure. Under normal operating conditions, flushing liquid need be provided to these nozzles only periodically or as needed to clear the surface of thrust pad 56 or to flush away any solid material collected by scraper 115.

FIG. 9 shows an alternative hydrostatic bearing arrangement comprising pockets 120 similar and located similarly to the pockets 80 in the surface of plate 55, but instead of a surrounding sealing ring, each pocket 120 is surrounded by a U-shaped channel 121 having an outlet 122. In operation, hydrostatic fluid enters and fills each pocket 120 from its inlet 123 connected with a supply system which may be the same as described in connection with FIG. 5. A limited amount of lubricant will be allowed to escape from pockets 120 by overflowing to the channel 121 for return to the supply tank from outlet 122. If desired, the lubricant can be cooled by appropriate means (not shown) before recycling. The arrangement of FIG. 9 should also be provided with a modulating control as described in connection with element 95 in FIG. 5.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A cone press comprising:

(a) a frame, (b) a pair of rigid side structures supported on said frame for relative pivotal movement, (c) a pair of rotor assemblies having their axes arranged at an angle to each other and including confronting faces defining a pressing zone, (d) means mounting each of said rotor assemblies for rotation in a respective said side structure, (e) each said rotor assembly including a conically shaped screen forming said confronting face thereof and an annular plate forming the axially outer face thereof, (f) drive means for rotating said rotor assemblies to bring portions of said screens into proximity in a pinch zone while separating other portions of said screens to form a feed receiving zone, (g) thrust bearing means interposed between said annular plates and said side structures and including an annular thrust pad on each said annular plate for transmitting to the associated said side structures the thrust generated by said confronting faces in said pressing zone, (h) hydrostatic bearing means for hydraulically compensating for said thrust between said thrust pads and said side structures to minimize the energy requirements for operation of said press, (i) said hydrostatic bearing means comprising means defining at least one open pocket in each said side structure, and means for supplying pressurized fluid to each said pocket to form a fluid cushion between said pocket and said annular plate means, and (j) means responsive to the load on said drive means for increasing and decreasing said fluid supply in relation to said drive means load.

2. A press as defined in claim 1 wherein said hydrostatic bearing means are located between said annular plates and said said structures generally in line with said pinch zone.

3. A press as defined in claim 1 further comprising a plurality of said pocket defining means, and means for selectively regulating said fluid supplying means for each of the resulting said pockets.

4. A press as defined in claim 1 further comprising means defining a channel in said side structure arranged to receive and dispose of fluid overflowing each said pocket.

5. A press as defined in claim 1 further comprising a yieldable sealing member mounted in said side structure in surrounding relation with each said pocket and are yieldable sealing engagement with said annular plate for minimizing leakage of fluid from said pocket.

6. A press as defined in claim 1 further comprising means for cleaning the surface of each said thrust pad at a position ahead of said pinch zone in the direction of rotation of said rotor assembly.

7. A press as defined in claim 6 wherein said cleaning means comprises means for flushing said surface with cleaning liquid.

8. A press as defined in claim 6 wherein said cleaning means comprises means for scraping said surface.

* * * * *

UNITED STATES PATENT AND TRADEMARK OFFICE

CERTIFICATE OF CORRECTION

PATENT NO. : 4,099,458

DATED : July 11, 1978

INVENTOR(S) : Peter Seifert

It is certified that error appears in the above-identified patent and that said Letters Patent are hereby corrected as shown below:

Column 8, line 52, "said said" should be

--said side--.

Column 8, line 64 "and are" should be --and in--.

Signed and Sealed this

*Second* Day of *January 1979*

[SEAL]

*Attest:*

RUTH C. MASON
*Attesting Officer*

DONALD W. BANNER
*Commissioner of Patents and Trademarks*